US010370177B2

(12) United States Patent
Cassidy et al.

(10) Patent No.: US 10,370,177 B2
(45) Date of Patent: Aug. 6, 2019

(54) DUAL COMPONENT INSERT WITH UNIFORM DISCHARGE ORIFICE FOR FINE MIST SPRAY

(71) Applicant: SUMMIT PACKAGING SYSTEMS, INC., Manchester, NH (US)

(72) Inventors: John Cassidy, Medina, OH (US); Kevin G. Verville, Deerfield, NH (US); Elizabeth A. Green, Kingston, NH (US)

(73) Assignee: SUMMIT PACKAGING SYSTEMS, INC., Manchester, NH (US)

( * ) Notice: Subject to any disclaimer, the term of this patent is extended or adjusted under 35 U.S.C. 154(b) by 0 days.

(21) Appl. No.: 15/358,643

(22) Filed: Nov. 22, 2016

(65) Prior Publication Data

US 2018/0141744 A1 May 24, 2018

(51) Int. Cl.
*B65D 83/28* (2006.01)
*B65D 83/14* (2006.01)

(52) U.S. Cl.
CPC ..... *B65D 83/28* (2013.01); *B65D 83/753* (2013.01)

(58) Field of Classification Search
CPC ..... B65D 83/28; B65D 83/205
USPC ..... 222/402.1; 239/354, 596, 601, 333, 337, 239/491, 492, 494
See application file for complete search history.

(56) References Cited

U.S. PATENT DOCUMENTS 53,109 A * 3/1866 Burchardt ..... F02M 61/1853 239/596
1,166,340 A * 12/1915 Erickson ..... B05B 1/3436 239/491
1,276,245 A * 8/1918 Millard ..... F02M 61/1853 239/596
1,363,703 A * 12/1920 Zimmermann ..... B05B 1/3426 239/492

(Continued)

FOREIGN PATENT DOCUMENTS

EP 1 832 347 A1 12/2007

OTHER PUBLICATIONS

International Search Report Corresponding to PCT/US2017/060297 dated Feb. 27, 2018.

(Continued)

*Primary Examiner* — Patrick M. Buechner
*Assistant Examiner* — Michael J. Melaragno
(74) *Attorney, Agent, or Firm* — Davis & Bujold PLLC; Michael J. Bujold

(57) ABSTRACT

A dual component insert for use with a spray actuator for dispensing a pressurized product. The dual component insert comprises a support insert and an insert disk. The support insert includes a base wall which has a support discharge orifice formed therein and a cylindrical wall is formed integral with and extends from the base wall so as to define an insert cavity. The insert disk has a disk discharge orifice, a diameter of the disk discharge orifice is smaller than a diameter of the support discharge orifice, and the insert disk is received and captively retained within the insert cavity so that the disk discharge orifice is axially aligned with the support discharge orifice. The insert disk is manufactured from a relatively thin durable material which facilitates fabrication of a consistent, accurate, uniform and well (Continued)

defined small diameter discharge orifice which results in dispensing a fine mist spray.

18 Claims, 9 Drawing Sheets

(56) References Cited

U.S. PATENT DOCUMENTS 1,869,809 A * 8/1932 Hewlett ..... B05B 1/3436 239/494
2,493,209 A * 1/1950 Simmons ..... B05B 1/00 239/533.14
2,514,581 A * 7/1950 Janssen ..... F23D 11/103 239/11
2,746,801 A * 5/1956 Curran ..... B05B 1/3436 239/494
3,120,348 A 2/1964 O'Donnell
3,129,893 A * 4/1964 Green ..... B05B 1/3436 222/402.24
3,182,916 A * 5/1965 Schulz ..... B05B 1/14 239/432
3,192,611 A * 7/1965 Briechle ..... B05B 1/3436 239/468
3,378,205 A 4/1968 Barker
3,416,737 A 12/1968 Venus, Jr.
3,437,270 A 4/1969 Venus, Jr.
3,519,210 A * 7/1970 Du Plain ..... B05B 1/3436 239/492
3,580,431 A * 5/1971 Kuffer ..... B05B 1/3436 222/402.1
3,647,147 A 3/1972 Cook
3,679,132 A * 7/1972 Vehe ..... B05B 1/083 239/102.2
3,934,823 A * 1/1976 Reed ..... B05B 1/3405 239/472
3,948,444 A * 4/1976 Reed ..... B05B 1/3405 239/11
4,018,387 A * 4/1977 Erb ..... B05B 7/0416 239/338
4,036,439 A * 7/1977 Green ..... B05B 1/3436 239/466
4,071,196 A * 1/1978 Burke ..... B05B 1/3436 239/492
4,074,861 A * 2/1978 Magers ..... B05B 1/3436 239/492
4,122,982 A * 10/1978 Giuffredi ..... B05B 11/3018 222/321.2
4,128,206 A * 12/1978 Bintner ..... B05B 1/042 239/11
4,161,281 A * 7/1979 Erb ..... F23D 11/106 239/434
4,247,049 A * 1/1981 Gailitis ..... B65D 83/20 239/497
4,261,511 A * 4/1981 Erb ..... F23D 11/106 239/338
4,621,772 A 11/1986 Blythe et al.
4,664,315 A * 5/1987 Parmentar ..... B05B 5/043 239/402
4,971,254 A * 11/1990 Daly ..... F02M 51/061 239/396
4,997,113 A 3/1991 Kirschner
5,139,201 A * 8/1992 De Laforcade ..... B05B 7/0056 222/402.1
5,147,087 A * 9/1992 Fuchs ..... B05B 7/0416 239/333
5,167,776 A 12/1992 Bhaskar et al.
5,211,317 A * 5/1993 Diamond ..... B65D 83/48 220/666
5,350,119 A * 9/1994 Bergstrom ..... F02M 61/166 239/585.4
5,456,415 A * 10/1995 Gardner ..... B05B 7/0458 239/424
5,540,389 A * 7/1996 Knickerbocker ..... B05B 1/3431 239/463
5,577,666 A * 11/1996 Shen ..... F02M 69/047 239/290
5,620,142 A * 4/1997 Elkas ..... B05B 1/00 239/518
5,622,318 A * 4/1997 Bougamont ..... B05B 1/3436 239/333
5,626,295 A 5/1997 Heyse et al.
5,711,488 A * 1/1998 Lund ..... B05B 1/3436 239/333
5,769,325 A * 6/1998 Jouillat ..... B05B 1/3436 222/333
5,992,765 A 11/1999 Smith
6,199,766 B1 3/2001 Fox et al.
6,241,165 B1 * 6/2001 Bickart ..... B05B 1/3436 239/463
6,612,510 B1 * 9/2003 Fox ..... B05B 1/02 239/3
6,634,386 B1 * 10/2003 Maloney ..... B60T 8/34 138/30
6,983,896 B2 * 1/2006 Zur ..... B05B 1/14 239/463
7,143,959 B2 12/2006 Smith et al.
7,195,139 B2 3/2007 Jaworski et al.
RE39,767 E 8/2007 Soule et al.
7,886,995 B2 * 2/2011 Togashi ..... B05B 1/341 222/321.8
8,052,627 B2 * 11/2011 Gromer ..... A61C 1/0092 239/490
8,333,332 B2 * 12/2012 Burghaus ..... B65D 83/345 239/114
8,640,977 B2 * 2/2014 Songbe ..... B05B 1/3436 222/402.1
9,604,773 B2 * 3/2017 Verville ..... B65D 83/205
2002/0179742 A1 * 12/2002 Yildirim ..... F02M 45/086 239/533.3
2003/0218082 A1 * 11/2003 Malcolm ..... B05B 1/34 239/589
2004/0238573 A1 * 12/2004 Parmentier ..... B05B 1/3436 222/321.1
2005/0155986 A1 * 7/2005 Mizukawa ..... B05B 11/0027 222/148
2006/0022070 A1 2/2006 Knol et al.
2006/0049282 A1 3/2006 Bowman et al.
2014/0145009 A1 * 5/2014 Hartranft ..... B05B 1/08 239/302
2014/0367490 A1 * 12/2014 Neuhalfen ..... B05B 1/042 239/337
2016/0236853 A1 * 8/2016 Verville ..... B65D 83/205
2018/0141744 A1 * 5/2018 Cassidy ..... B65D 83/205

OTHER PUBLICATIONS

Written Opinion Corresponding to PCT/US2017/060297 dated Feb. 25, 2018.

* cited by examiner

DUAL COMPONENT INSERT WITH UNIFORM DISCHARGE ORIFICE FOR FINE MIST SPRAY

FIELD OF THE DISCLOSURE

The present disclosure relates to a novel insert for an actuator of a pressurized aerosol valve and, more particularly, to a dual component insert which comprises both a support insert and a separate insert disk which has a uniform and well-defined discharge orifice which is designed to discharge the product to be dispensed in a fine mist spray pattern.

BACKGROUND OF THE DISCLOSURE

Pressurized aerosol products typically comprise a container, usually a cylindrical metal can, containing both a propellant gas or compressed air along with the desired product to be dispensed and a valve assembly and actuator for controllably dispensing of the product as an aerosol. One end of the container is closed by a metal dome which is crimped and sealed to the upper side wall of the container and has a central opening for receiving a metal mounting cup which is crimped and sealed to the dome. The mounting cup, in turn, has a central pedestal with a central opening for mounting a conventional valve assembly thereto. A first end of a dip tube is connected with a lower portion of the valve assembly. The valve assembly provides a controllable flow passage from an inlet, formed in a second free end of the dip tube which extends downward and communicates with the product to be dispensed, typically located in the bottom portion of the aerosol container, to an outlet formed at a remote end of a valve stem which extends through the central opening in the pedestal and supports an actuator. The actuator, in turn, generally has a flow passage, extending from the outlet of the valve stem, through the body of the actuator and to a discharge outlet formed in the actuator. The discharge outlet typically accommodates a discharge member, normally in the form of an insert, which is sized and shaped to engage with the discharge outlet and provide the desired discharge spray pattern for the product when dispensed. The actuator, when depressed, moves vertically downward, with respect to the valve assembly and the pedestal, and actuates the valve assembly to open the valve so that the product to be dispensed can then flow through and along the controllable flow passage of the valve assembly and the actuator and eventually be dispensed through the discharge outlet of the actuator.

When the actuator is released, the valve assembly is biased, by a spring, back into its normally closed position to prevent further dispensing of product though the valve assembly. Such biasing action of the spring also, in turn, returns the actuator back to its normally extended position, with respect to the pedestal, so that the actuator is then repositioned to be again depressed, by an operator, and thereby facilitate further dispensing of product from the container.

Known actuators and inserts are typically formed from molded plastics and the like. One problem which frequently occurs with such known actuators and inserts is that it is often very difficult to manufacture inserts with small diameter orifices—in a consistent, reliable, and uniform manner—through which the product can be dispensed in a desired spray pattern.

SUMMARY OF THE DISCLOSURE

Wherefore it is an object of the present disclosure to overcome the above-mentioned shortcomings and drawbacks associated with the prior art actuators and inserts with smaller dispensing orifices.

The present disclosure relates to a dual component insert for use with a spray actuator for dispensing a pressurized product, the dual component insert comprising: a support insert comprising: a base wall having a support discharge orifice formed therein; a cylindrical wall being formed integral with and extending from the base wall so as to define an insert cavity; an insert disk having a disk discharge orifice; a diameter of the disk discharge orifice being smaller than a diameter of the support discharge orifice; and the insert disk being received and captively retained within the insert cavity such that the disk discharge orifice is axially aligned with the support discharge orifice.

The present disclosure also relates to an actuator for dispensing a pressurized product, the actuator comprising both: a dual component insert comprising: a support insert comprising: a base wall having a support discharge orifice formed therein; a cylindrical wall being formed integral with and extending from the base wall so as to define an insert cavity; an insert disk having a disk discharge orifice; a diameter of the disk discharge orifice being smaller than a diameter of the support discharge orifice; and the insert disk being received and captively retained within the insert cavity such that the disk discharge orifice being axially aligned with the support discharge orifice; a spray actuator comprising: a housing having an inlet communicating, via a passageway, with an actuator discharge cavity; the actuator discharge cavity being opened at one end and having a cylindrical post located therein supporting a mechanical break-up on an end face; and the dual component insert being received and captively retained within the actuator discharge cavity of the spray actuator so as to seal the opened end of the actuator discharge cavity and facilitate dispensing of product through the mechanical break-up and the axially aligned disk and support discharge orifices.

Yet another aspect of the present disclosure relates to an actuator for dispensing a pressurized product, the actuator comprising both: a dual component insert comprising: a support insert comprising: a base wall having a support discharge orifice formed therein; a cylindrical wall being formed integral with and extending from the base wall so as to define an insert cavity; an insert disk having a disk discharge orifice and the disk discharge orifice having a diameter ranging from about 0.002 of an inch to about 0.010 of an inch; the insert disk having an insert disk diameter ranging from about 0.100 of an inch to about 0.160 of an inch, and the insert disk having a thickness ranging from about 0.003 of an inch to about 0.007 of an inch; a diameter of the disk discharge orifice being smaller than a diameter of the support discharge orifice; the insert disk being received and captively retained within the insert cavity such that the disk discharge orifice being axially aligned with the support discharge orifice; a spray actuator comprising: a housing having an inlet communicating, via a passageway, with an actuator discharge cavity; the actuator discharge cavity being opened at one end and the actuator discharge cavity having a cylindrical post located therein supporting a mechanical break-up on an end face thereof; the cylindrical post supporting a plurality of spaced apart fins, and each of the plurality of spaced apart fins extending radially and axially from the cylindrical post; the dual component insert being received and captively retained within the actuator discharge cavity so as to seal the opened end of the actuator discharge cavity and facilitate dispensing of product through the mechanical break-up and the axially aligned disk discharge orifice and the support discharge orifice; and the spray actuator being supported by a valve stem which is coupled to a valve assembly, an inlet of the valve assembly supporting a dip tube for conveying the product to be dispensed to the valve assembly, and the valve assembly being secured to a mounting cup.

Still another aspect of the present disclosure is to manufacture the insert disk from a first non-moldable material, such as a metal, and manufacture the support insert from a second moldable material, such as plastic, e.g., acetal.

A further aspect of the present disclosure is to manufacture the insert disk from a relatively thin durable material which can be punched, drilled, machined or otherwise fabricated so as to have a consistent, accurate, uniform and well defined small diameter discharge orifice formed therein which results in discharging of the product to be dispensed as a fine mist spray.

Yet another aspect of the present disclosure is to manufacture the support insert and the insert disk as two completely separate components and from two different materials and, thereafter, subsequently assemble those two components with one another to form the dual component insert.

The above aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

Figure 1A:
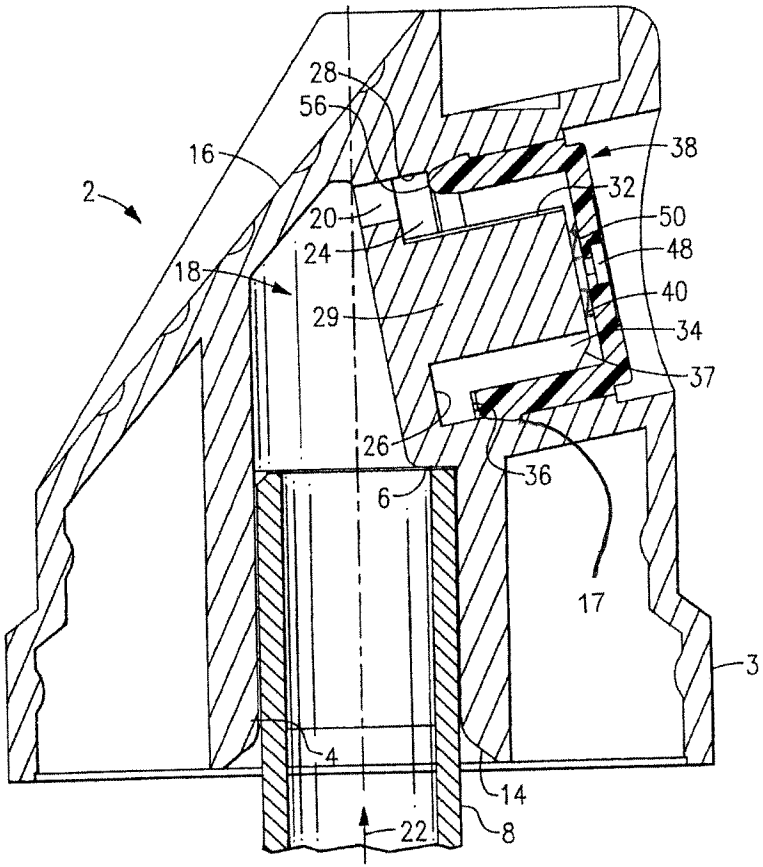
FIG. 1A is a diagrammatic cross section of an actuator and an insert.

Referring first to FIG. 1A, a general description concerning a spray actuator 2, will now be provided. As shown in this Figure, the spray actuator 2 comprises an exterior housing 3 which is provided with a product inlet 4, having a stop ledge 6, which matingly engages with a remote free end of a valve stem 8 (only partially shown in this Figure) of a spray valve 10 supported by an aerosol or some other pressurized container 12 (See FIG. 1B). The product inlet 4 is provided with a perimeter chamfer 14 which facilitates receiving of the remote free end of the valve stem 8 therein.

The actuator 2, in turn, generally defines a flow passage 18 which extends from the inlet 4, through the body of the actuator 2 to a discharge cavity opening 20 that facilitates conveyance of the pressurized product 22 into a discharge cavity 24 of the spray actuator 2. The discharge cavity 24 is defined by a base surface 26 and an inwardly facing cylindrical side wall 28 of the housing 3. The base surface 26 supports a centrally located cylindrical post 29 which is formed integrally with the base surface 26. The discharge cavity 24 is opened at the end thereof which is opposite the base surface 26. An insert 38, provided with a discharge outlet 48, is captively received, accommodated and retained within the discharge cavity 24 to close the discharge cavity 24. The discharge outlet 48 is sized and shaped to form the desired discharge spray pattern for the product to be dispensed 22 when the product to be dispensed flows into the discharge cavity 24, through a conventional mechanical break-up 40 (only diagrammatically shown) and out through the discharge outlet 48.

A top exterior surface of the spray actuator 2 is provided with a finger recessed area 16, which is typically contoured to facilitate depression of the spray actuator 2 by a finger, e.g., an index finger, of a user. The actuator 2, when depressed by an operator depressing the top finger recessed area 16, moves vertically downward, with respect to the valve assembly 10 and the pedestal, and actuates the valve assembly 10 to open the valve assembly so that the product 22 (see FIG. 2) can then flow through and along the dip tube DT and the passageways of the valve assembly 10 and the actuator 2 and eventually be dispensed through the discharge outlet 48. When the actuator 2 is released, however, the valve assembly 10 is biased back to its normally closed position, by an internal spring, to prevent further dispensing of the product to be dispensed 22 though the valve assembly 10. Such biasing action of the spring also, in turn, returns the actuator 2 back into its normal position, with respect to the pedestal, so that the actuator is then repositioned to be again depressed, by an operator, and thereby facilitate further dispensing of the product 22 from the container 12. As the present disclosure more specifically relates to improvements concerning the discharge orifice of the insert, a further detailed description concerning remaining features of the conventional spray valve and the pressurized container 12 is not provided beyond what is generally shown in FIGS. 1A and 1B.

Figure 1B:
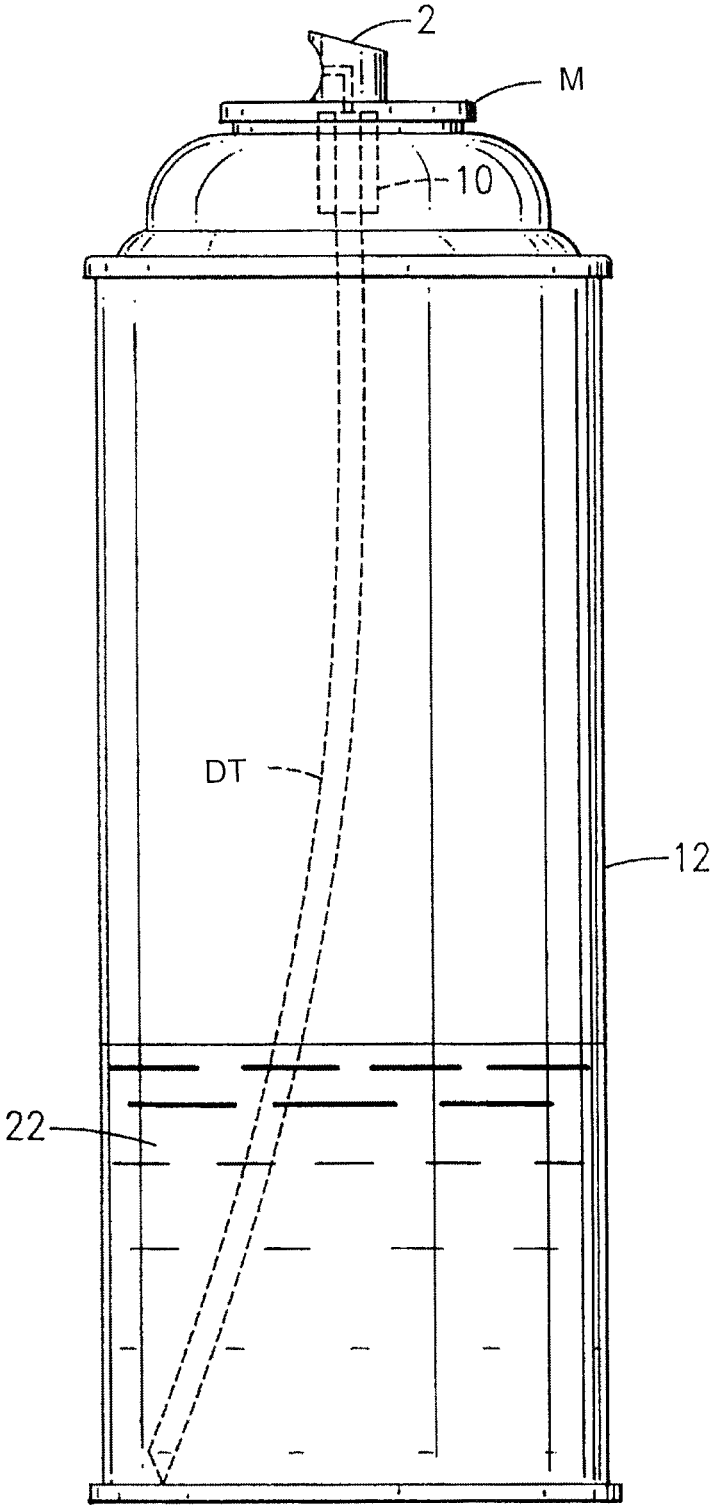
FIG. 1B is a diagrammatic view of a pressurized container with an actuator which facilitates dispensing of product from the pressurized container.

As shown in FIG. 1B, a conventional pressurized container 12 has a mounting cup M which is crimped, in a conventional manner, to an aperture provided in a top portion of the pressurized container 12. The mounting cup M, in turn, supports the valve assembly 10 which is crimped, in a conventional manner, to a central aperture formed therein and the valve assembly 10 controls the flow of the pressurized product 22, in a conventional manner, from the pressurized container 12 through the valve assembly 10 and the valve stem 8. As such features are conventional and well known in the art, a further detailed description concerning the same is not provided.

The remote end of the valve stem 8 is received within the product inlet 4 of the spray actuator 2 (FIG. 1A) and typically has an interference fit therewith to securely retain the engagement between those two components with one another. Due to such engagement, when the spray actuator 2 is depressed or suitably tilted (for a tilt valve), the valve stem 8, in turn, is depressed or tilted (depending upon the type of valve) and this commences the flow of the pressurized product 22 from the pressurized container 12 through and along the dip tube DT, the valve assembly 10, the valve stem 8, the passageway 18, the opening 20, and into the discharge cavity 24 and finally through the mechanical break-up 40 and out through the discharge outlet 48.

An outwardly facing side wall 32 of the cylindrical post 29 carries a plurality of equally spaced support fins 34, e.g., three or possibly four or more equally spaced support fins. A portion of each one of the support fins 34, adjacent the base surface 26, is provided with a radially extending stop shoulder 36 while the opposite end of the fins 34 is each provided with a chamfer 37 which facilitates receiving an insert 38 with the discharge cavity 24. The support fins 34 are located, sized and shaped to facilitate centering of the insert 38 as the insert 38 is received within the discharge cavity 24. The shoulders 36 are designed to prevent over-insertion of the insert 38 into the discharge cavity 24.

The discharge orifice 48 is formed centrally in an inwardly facing planar base surface 50 of the insert 38 and the discharge orifice 48 extends completely through the base wall 49 to an outwardly facing planar base surface 51 thereof. A cylindrical side wall 52 extends normal to a peripheral edge of the base wall 49. An inwardly facing cylindrical side wall 58 generally mates, e.g., has a slight interference fit, with the fins 34 when the insert 38 is received within the discharge cavity 24. An outwardly facing surface of the cylindrical side wall 52 supports an outwardly facing annular lip 54 (see FIGS. 1A and 3B) which frictionally engages with the inwardly facing cylindrical side wall 28 of the spray actuator 2 of the discharge cavity 24. The annular lip 54 of the insert 38 is sized to have an interference fit, e.g., a few thousands of an inch or so, with the inwardly facing cylindrical side wall 28 of the spray actuator 2 so that a "biting" action is achieved between those two components when mated with one another, i.e., the relatively harder annular lip 54 typically forms a small indentation 17 in the relatively softer inwardly facing cylindrical side wall 28 of the spray actuator 2. Such "biting" action insures that the insert 38, once fully received, inserted or seated into the discharge cavity 24, will not be inadvertently removed therefrom. The end surface 56 of the insert 38, adjacent the annular lip 54, is typically provided with a chamfer 53 (see FIGS. 1 and 3B) which assists with inserting the insert 38 into the discharge cavity 24 of the spray actuator 2.

The axial length of the side wall 52 of the insert 38 and/or the axial height of the shoulders 36 of the fins 34 are selected such that when the insert member 38 is fully inserted into and received by the discharge cavity 24, an end face 56 (see FIG. 1A) of the insert 38 abuts against the shoulder or shoulders 36 of the support fins 34 while the inwardly facing planar base surface 50 abuts against the conventional mechanical break-up 40 (only diagrammatically shown). The mechanical break-up 40, as is well known in the art, assists with breaking up the product 22 to be dispensed into finer particles or spray immediately before being discharged out through the discharge orifice 48 of the insert 38. The insert 38 is sufficiently inserted so that the inwardly facing planar base surface 50 of the insert 38 is sealed against the mechanical break-up and so the pressurized product 22 must flow through the supply passages of the mechanical break-up 40 prior to being discharged out through the discharge orifice 48 of the insert 38. However, it is to be appreciated that the engagement between the planar inwardly facing base surface 50 of the insert 38 and the end surface of the mechanical break-up 40 must not sufficiently deform, compress or distort the passages of the mechanical break-up 40 so as to alter significantly the flow characteristics of the pressurized product flowing as the product 22 flows through the mechanical break-up 40.

According to previous insert arrangements, it is difficult to reliably, consistently and accurately manufacture smaller diameter discharge orifices 48, e.g., less than 0.010 of an inch and more preferably less than 0.0055 of an inch for example, which have a uniform and well defined cylindrically shaped discharge orifice 48 formed in a base wall of the insert 38. That is, following release from the mold, the partially cooled plastic material, from which the insert 38 is manufactured, is still generally partially molten and flowable. As the insert 38 continues cooling, following ejection from the mold, the molten material defining the sidewall of the discharge orifice has a tendency to modify/deform/alter the originally manufactured size and shape, e.g., typically cylindrical, of the discharge orifice 48. Due to the relatively small size of the discharge orifice 48, even a small amount of modification/deformation/alteration of the sidewall, defining the discharge orifice 48, can significantly alter the flow characteristics of the product flowing through the discharge orifice 48 and thereby the discharge characteristics of the fine particle spray emitted from the discharge orifice 48.

As briefly alluded to above, conventional inserts are typically formed from polymer resins that are melted, injected into a mold, allowed to partially solidify, and then removed from the mold and subsequently allowed to gradually cool further. These resins require properties such as low friction, wear resistance, high strength, stiffness, impact resistance and the like. The current formation processes for inserts makes it very difficult to achieve a uniform, consistent and accurately sized and shaped discharge orifice 48 for an insert, particularly for a fine mist and spray application.

Figure 2:
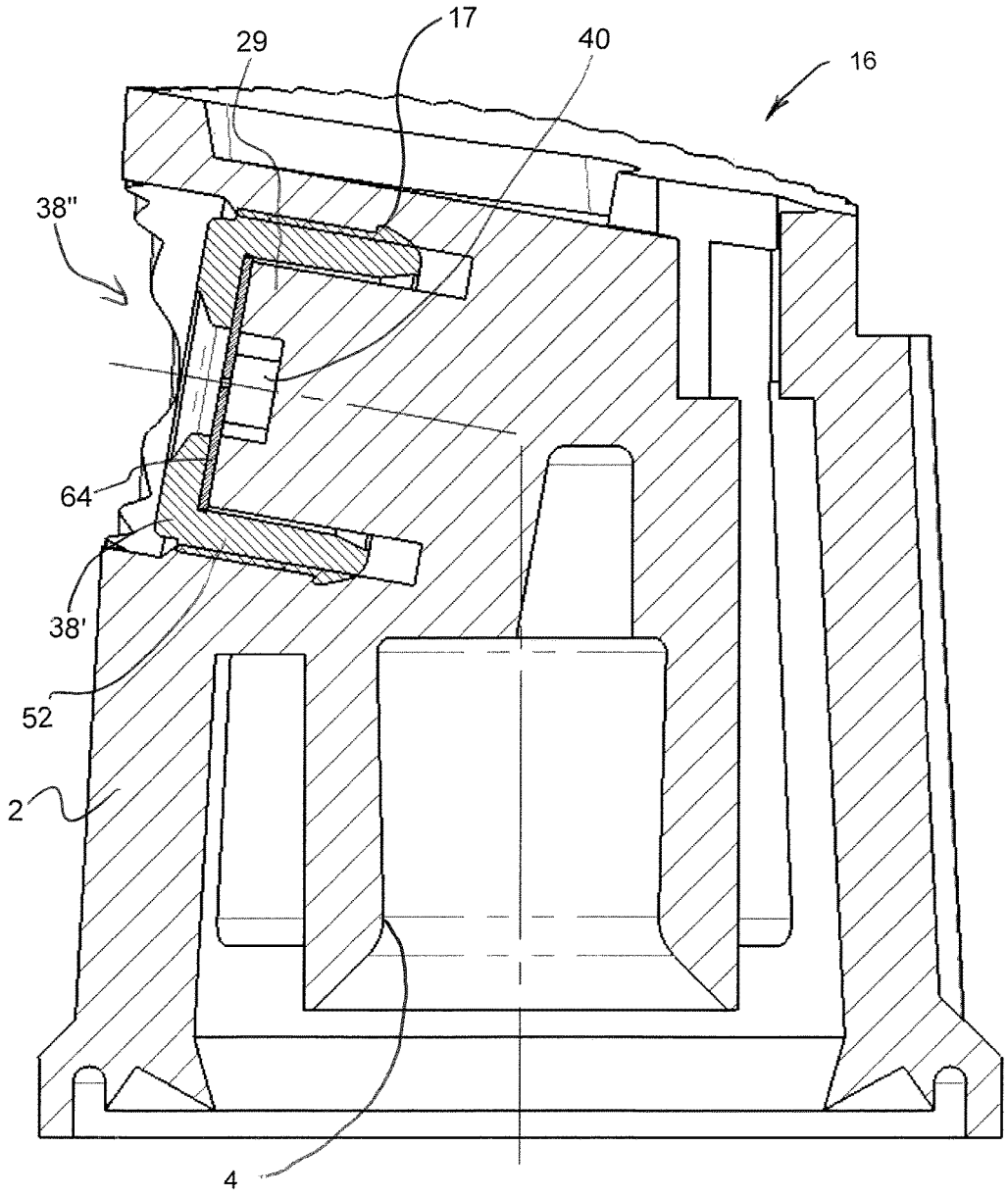
FIG. 2 is a diagrammatic cross section of one embodiment of the dual component insert according to the present disclosure.
Figure 4B:
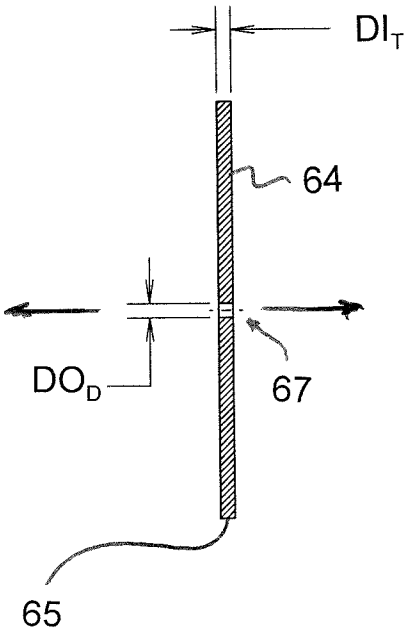
FIG. 4B is a diagrammatic cross-sectional view of the insert disk along section line 4B-4B of FIG. 4A.
Figure 4A:
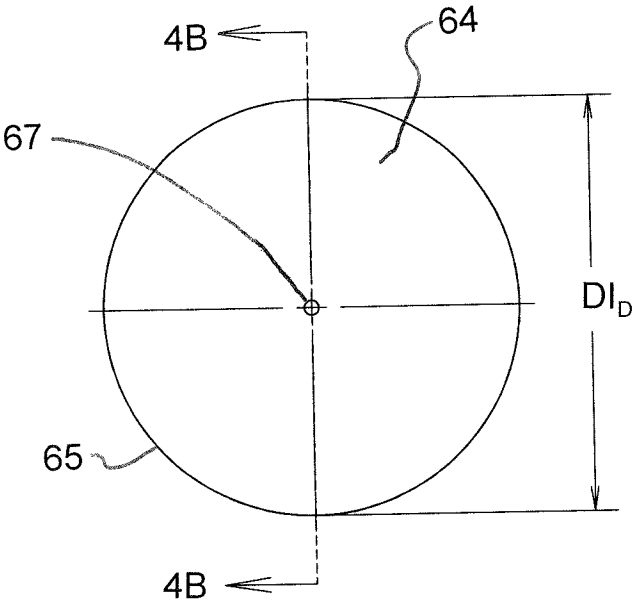
FIG. 4A is a diagrammatic front elevational view of one embodiment of an insert disk according to the principles of the present disclosure.
Figure 5:
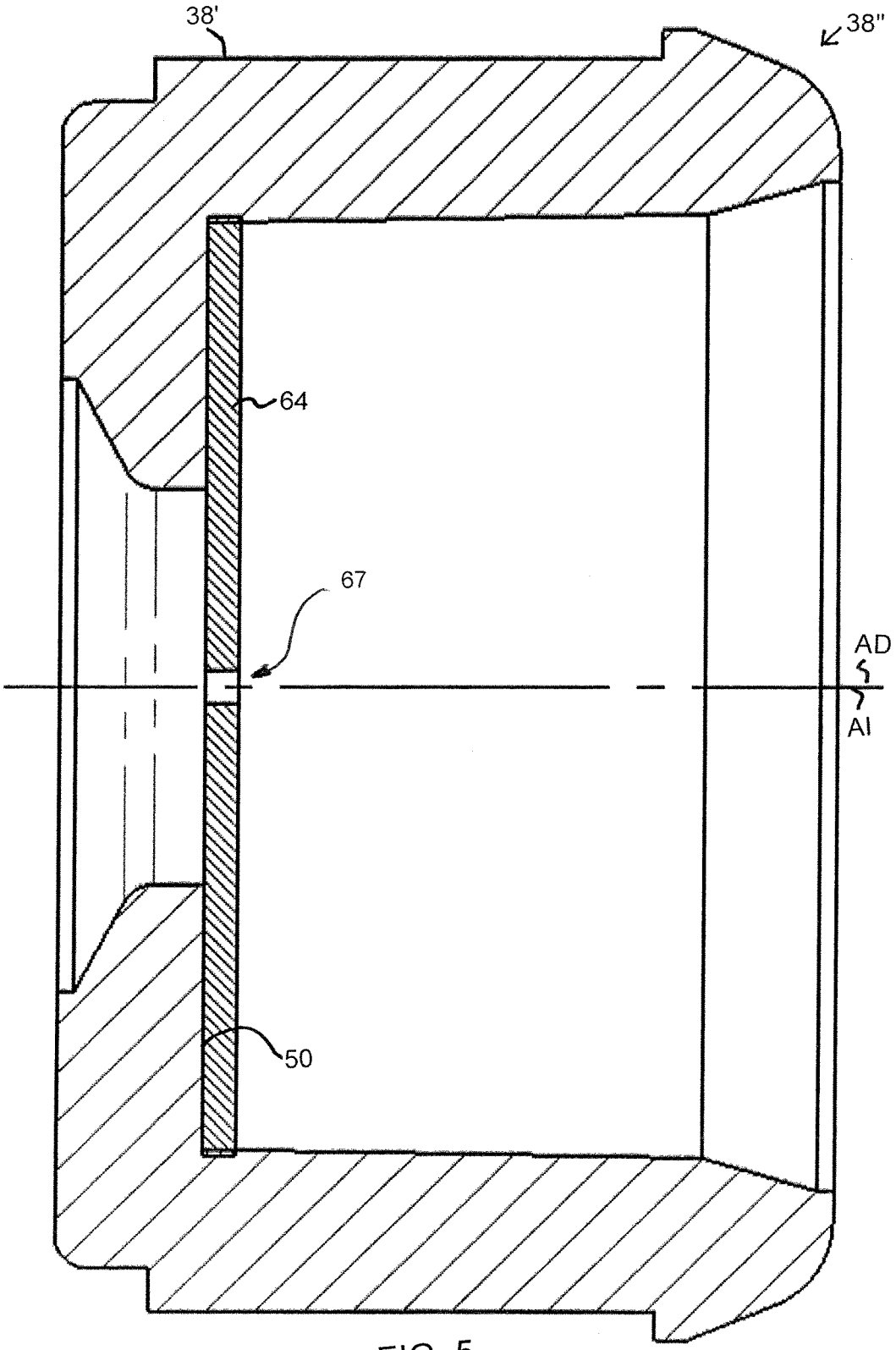
FIG. 5 is a diagrammatic cross-sectional view showing the insert disk assembled with the support insert to form the dual component insert.

Referring now to FIGS. 2-5, the dual component insert 38 according to the present invention is generally shown and will now be discussed in detail. As shown in FIG. 2, the actuator 2 is shown as comprising a dual component insert 38". The dual component insert 38" comprises a support insert 38', i.e., the first component of the dual component insert 38", which accommodates an insert disk 64, i.e., the second component of the dual component insert 38", which has a relatively small insert orifice formed therein, e.g., an orifice less than 0.010 of an inch and more preferably less than 0.0055 of an inch for example. It is to be appreciated that the support insert 38' and the insert disk 64 are manufactured as two completely separate components and from two different materials and, thereafter, subsequently assembled with one another to form the dual component insert 38" as shown in FIG. 5. That is, the support insert 38' is typically manufactured from a moldable material, such as acetal, while the insert disk 64 is manufactured from a material, e.g., a metal such as steel, aluminum, etc., which is fabricated, e.g., machined, stamped, punched, drilled, etc., and not molded.

Also according to the present invention, the spray actuator 2 is typically manufactured from a softer material, such as polyethylene or polypropylene, while the support insert 38' is preferably manufactured from a relatively harder molded plastic material, such as acetal, than the spray actuator 2.

Figure 3B:
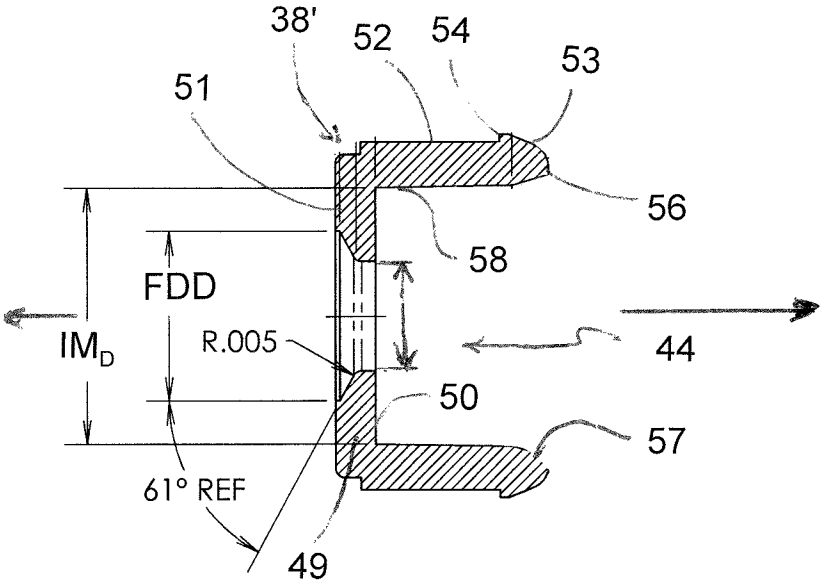
FIG. 3B is a diagrammatic cross-sectional view of the support insert along section line 3B-3B of FIG. 3A.
Figure 3A:
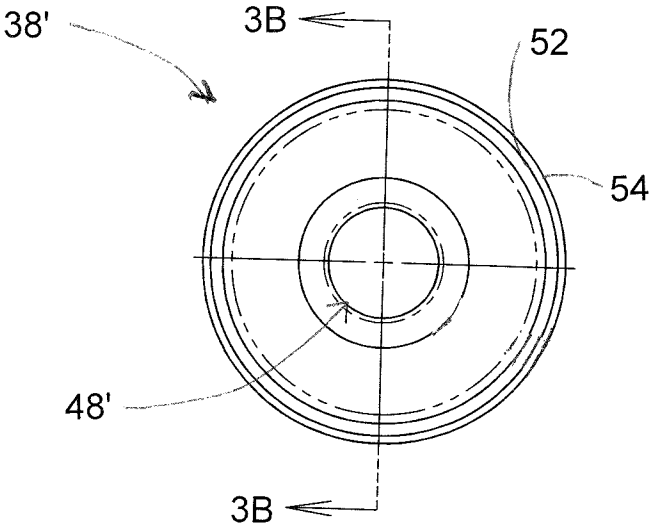
FIG. 3A is a diagrammatic front elevational view of one embodiment of a support insert according to the principles of the present disclosure.

Turning now to FIGS. 3A and 3B, one embodiment of the support insert 38' of the present invention is generally shown. In FIG. 3A, a series of concentric circles, denoting the various contours of the base surface of the support insert 38', are generally shown. For example, according to this embodiment, the inner most circle depicts the discharge orifice 48', which is rather large in comparison to the discharge orifice 48 of previous inserts. According to this embodiment, the support discharge orifice 48' typically has a diameter that ranges from about 0.010 of an inch to about 0.090 of an inch, more preferably ranges from about 0.045 of an inch to about 0.075 of an inch, and most preferably is about 0.060 of an inch or so. The support insert 38' has a base wall thickness which typically ranges from about 0.015 of an inch to about 0.030 of an inch, and more preferably the thickness ranges from about 0.021 of an inch to about 0.024 of an inch. The base wall of the support insert 38' is typically sufficiently thick and robust so as to provide adequate support for the insert disk 64 and maintain the insert disk 64, following installation, in constant abutting engagement with the mechanical break-up 40. As shown in FIG. 3B, the discharge orifice 48', formed in the base wall of the support insert 38', flares, e.g., at about a 61±15 degree angle, so as to have a final discharge diameter FDD of about 0.093 of an inch or so.

The support insert 38' typically has a height that ranges from about 0.100 of an inch to about 0.150 of an inch, and more preferably is about 0.120 of an inch. An inwardly facing cylindrical side wall of the support insert 38' typically has a diameter ($IM_D$) that ranges from about 0.098 of an inch to about 0.152 of an inch, and more preferably ranges from about 0.141 of an inch to about 0.145 of an inch. As shown in FIG. 3B, a leading end face 56 of the cylindrical side wall of the support insert 38' has a slight chamfer 57 which assists with receiving and centering the insert disk 64 within the insert cavity 44 of the support insert 38', as described below in further detail.

Turning now to FIGS. 4A and 4B, one embodiment of the insert disk 64, according to the present invention, is shown. The insert disk 64 is typically circular or cylindrical in shape and has an insert disk diameter ($DI_D$) that ranges from about 0.100 of an inch to about 0.160 of an inch, and more preferably ranges from about 0.142 of an inch to about 0.143 of an inch. As shown in FIG. 4B, the insert disk 64 typically has a thickness ($DI_T$) that ranges from about 0.002 on an inch to about 0.010 on an inch, and more preferably ranges from about 0.004 of an inch to about 0.006 of an inch. The insert disk 64 typically has a disk discharge orifice 67, generally centrally located, that is, during use (see FIG. 2) axially aligned with the relatively large support discharge orifice 48' formed in the support insert 38'. The disk discharge orifice 67 typically has a disk orifice diameter ($DO_D$) that ranges from about 0.002 of an inch to about 0.010 of an inch, and more preferably ranges from about 0.0045 of an inch to about 0.0055 of an inch.

Now that the features of both the support insert 38' and the insert disk 64 have been briefly described, assembly of these two components with one another to form the dual component member 38", as shown in FIG. 5, will now be described. During assembly of the insert disk 64 with the support insert 38', the insert disk 64 is first aligned with the insert cavity 44, defined by the cylindrical wall 52 and the inwardly facing planar base surface 50 of the support insert 38', so that the axes AD, AI of both the disk discharge orifice 67 and the discharge orifice 48' are substantially aligned and coincident with one another. Thereafter, the insert disk 64 is seated, e.g., pressed or forced into the insert cavity 44 of the support insert 38' along the axis AI of the discharge orifice 48', until a leading surface of the insert disk 64 abuts against the inwardly facing planar base surface 50 of the support insert 38', as shown in FIG. 5.

As noted above, the outer diameter $DI_D$ of the insert disk 64 is selected to be slightly larger, e.g., typically by 0.001-0.003 of an inch or so, than the diameter $IM_D$ of the inwardly facing cylindrical side wall of the support insert 38'. As a result of such slight interference fit, once fully seated, the insert disk 64 is captively and generally permanently retained within the insert cavity 44 of the support insert 38' and thus does not become separated or dislodged therefrom during subsequent handling and assembly of the dual component member 38". That is, the insert disk diameter $DI_D$ is normally sized to have an interference fit with the inwardly facing cylindrical side wall 58 of the support insert 38' which ensures that the insert disk 64, once suitably received or inserted within the insert cavity 44, will not be inadvertently dislodged therefrom.

Figure 6:
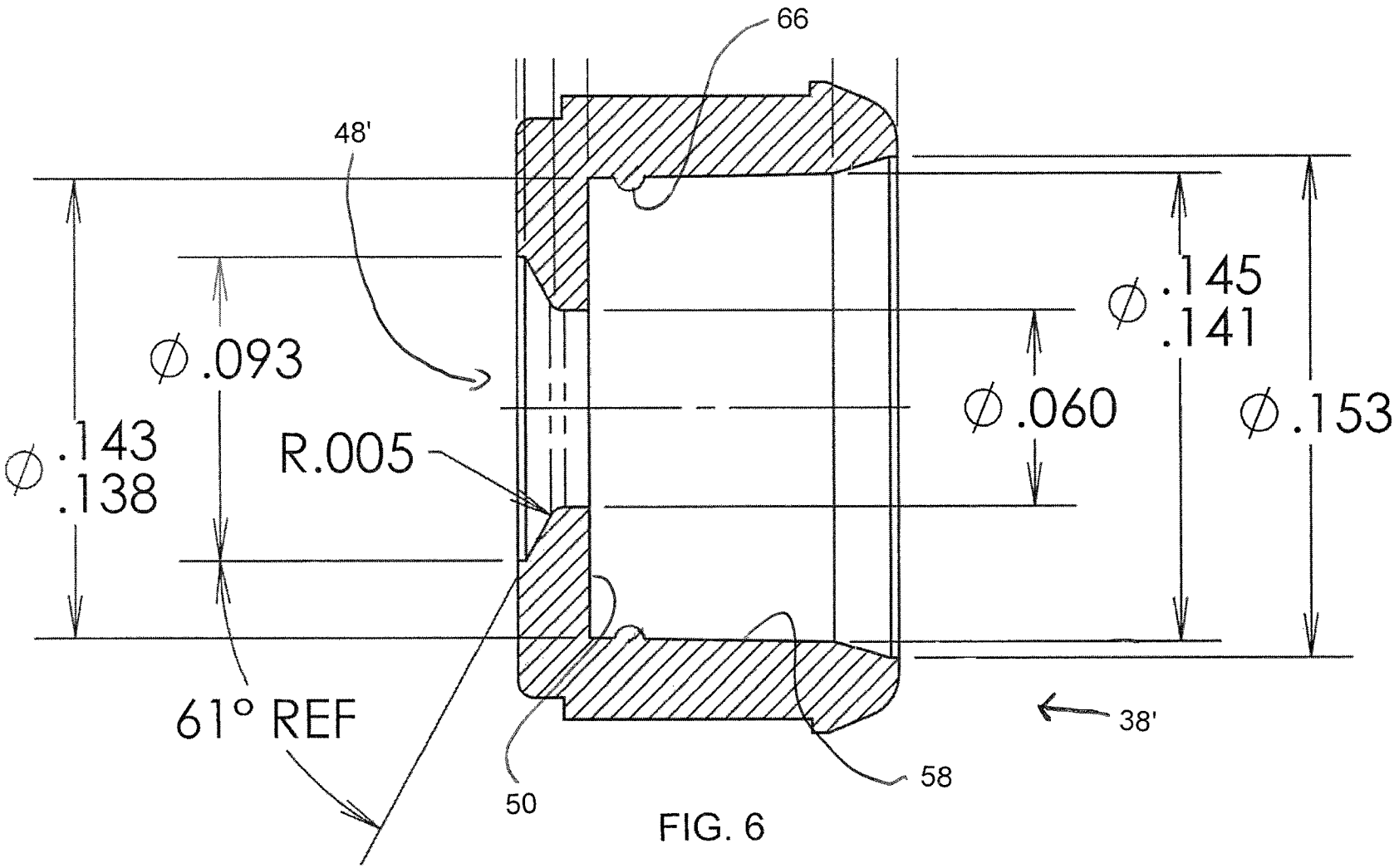
FIG. 6 is an enlarged diagrammatic cross-sectional view, similar to FIG. 3B, of another embodiment of the support insert with an inwardly facing surface provided with either a continuous or an interrupted annular protrusion for accommodating the insert disk.

According to another embodiment of the dual component member 38" as generally shown in FIG. 6, an inwardly facing surface 58 of the cylindrical wall of the support insert 38' is provided with either an interrupted annular protrusion or a continuous annular protrusion 66, spaced about 0.004 of an inch to about 0.006 of an inch or so from the inwardly facing planar base surface 50 of the support insert 38' and the diameter of the insert disk 64 may be slightly undersized by a few thousands of an inch, e.g., typically by 0.001-0.003 of an inch or so. During assembly, once the perimeter edge of the insert disk 64 passes over the interrupted or continuous annular protrusion 66, the insert disk 64 is captively retained in a substantially abutting relationship with the inwardly facing planar base surface 50 of the support insert 38' and thus does not become separated or dislodged therefrom during subsequent handling and assembly of the dual component member 38".

Figure 7:
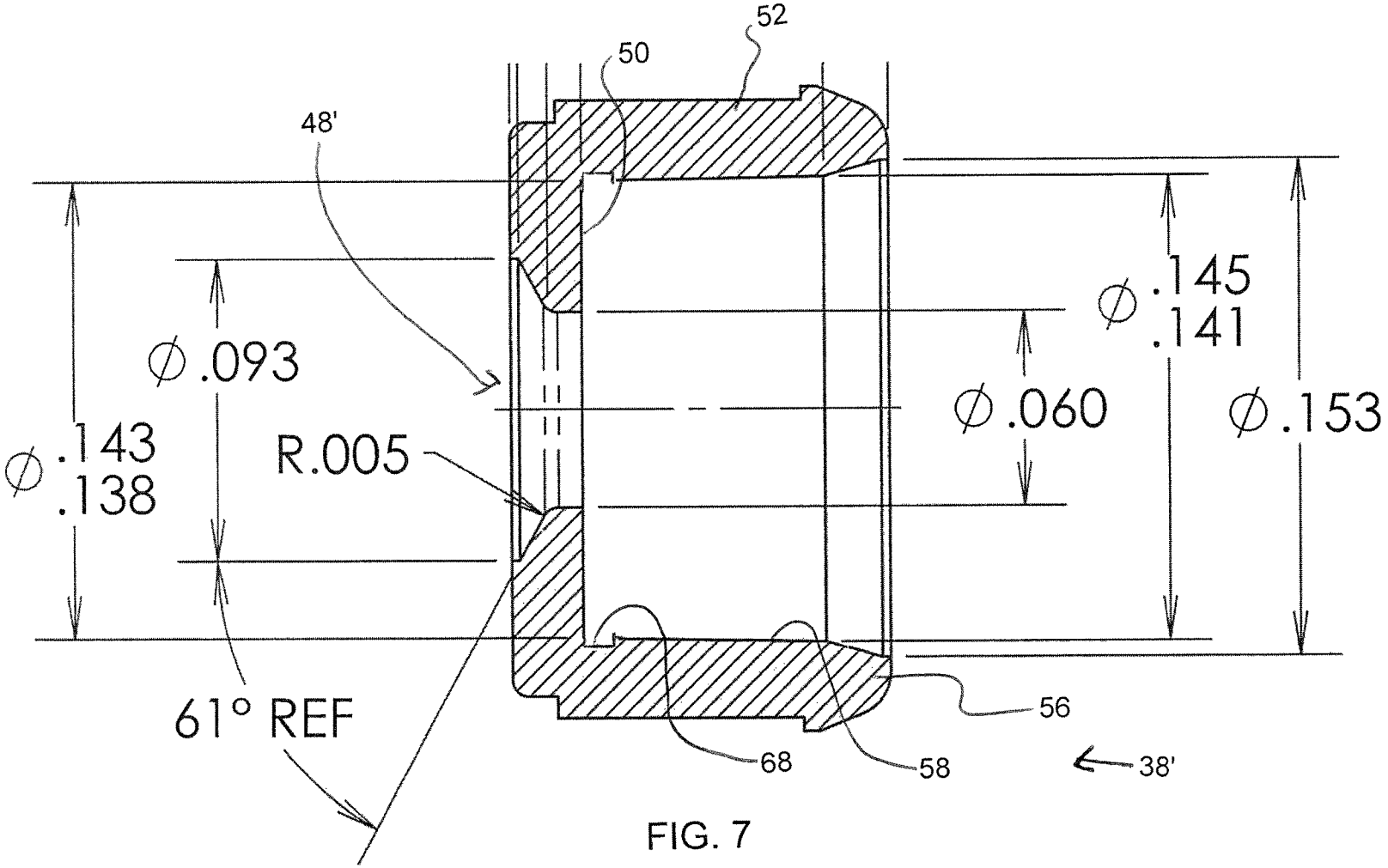
FIG. 7 is an enlarged diagrammatic cross-sectional view, similar to FIG. 3B, of a still further embodiment of the support insert with an inwardly facing surface of the insert provided with an annular groove, adjacent to the base surface of the support insert, for accommodating the insert disk.

In still another embodiment of the dual component member 38" as shown in FIG. 7, an inwardly facing surface 58 of the cylindrical wall of the support insert 38' may be provided with a slightly larger annular groove 68 which is formed adjacent to the inwardly facing base surface 50 of the support insert 38'. This annular groove 68 has a diameter which is slightly larger, e.g., a 0.001 to 0.003 of an inch or so, than the diameter $IM_D$ of the cylindrical wall 52 of the support insert 38'. During assembly, once the insert disk 64 abuts against the inwardly facing planar base surface 50 of the support insert 38', the outer peripheral edge 65 of the insert disk 64 is received within and captively retained by the annular groove 68 and thus does not become separated or dislodged therefrom during subsequent handling and assembly of the dual component member 38".

Figure 8:
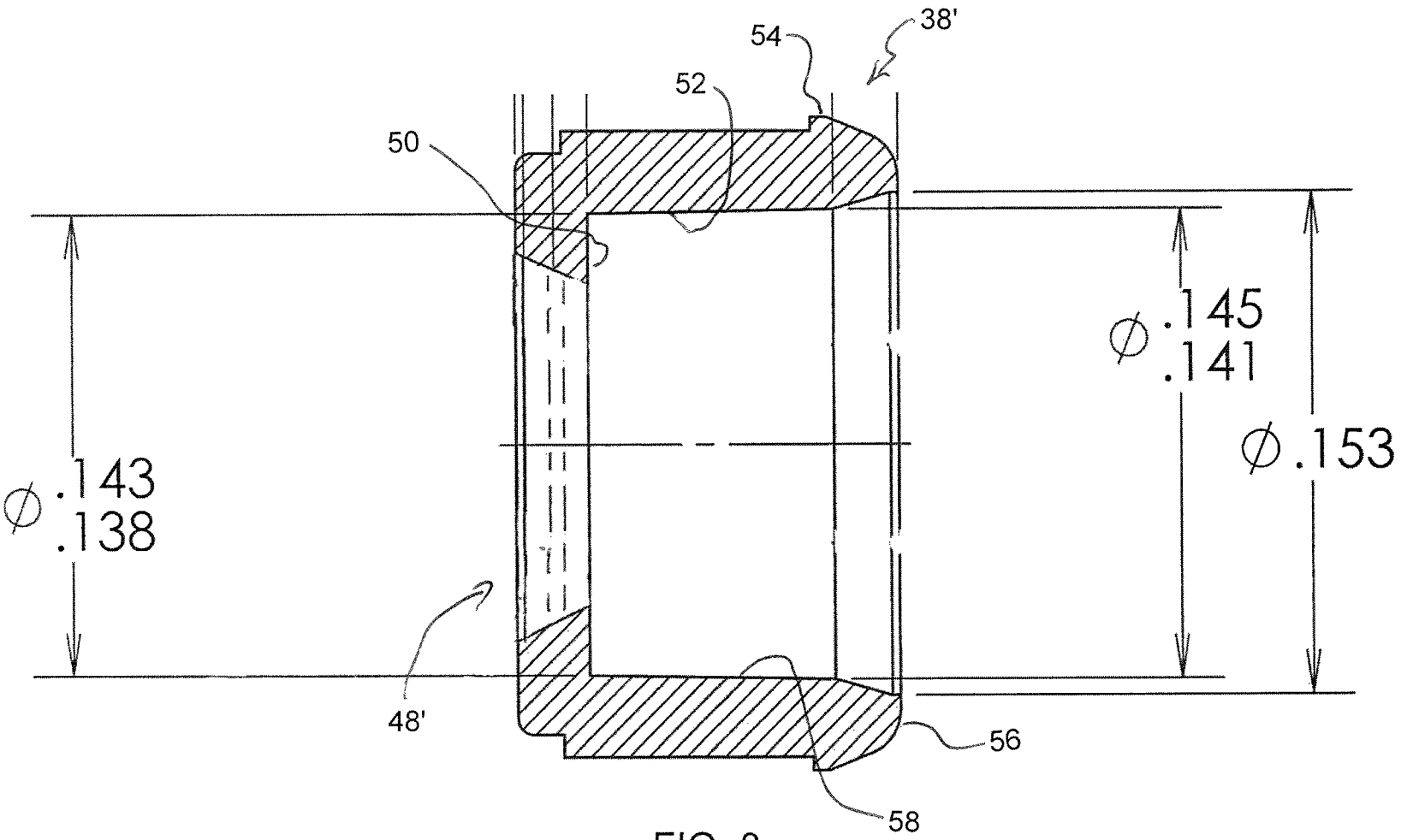
FIG. 8 is a diagrammatic cross-sectional view, similar to FIG. 3B, of yet another embodiment of the support insert according to the present disclosure.

Turning now to FIG. 8, a second embodiment of the present invention will now be described. As this embodiment is very similar to the previously discussed embodiment, only the differences between this embodiment and the previous embodiment will be discussed in detail while identical elements are given identical reference numerals.

The primary difference between this embodiment and the previous embodiment is the size and shape of the insert discharge orifice 48'. According to this embodiment, the insert discharge orifice 48' has a larger diameter than the previous embodiment and the shape of the insert discharge orifice 48' is also modified. Since the insert discharge orifice 48' has a larger diameter, the thickness of the base wall 49 of the support insert 38' may be increased to provide additional support for the insert disk 64 and prevent the same from becoming inadvertently deformed or spaced away from the mechanical break-up 40 during dispensing of the product 22 to be dispensed. It is to be appreciated that the overall shape, size and diameter of the insert discharge orifice 48' can vary, from application to application, as long as the insert discharge orifice 48' is sufficiently large to facilitate dispensing of the product 22 to be dispensed through the disk discharge orifice 67.

The insert disk 64, is fabricated—not molded—from a material that renders it much easier to uniformly and consistently manufacture the cylindrical side wall which defines the disk discharge orifice. The ability to reproduce accurately controlled and well defined smaller diameter discharge orifice, for an insert, is important for a variety of different applications. The ability to manufacture molded inserts having wider and less consistent discharge orifices considerably reduces costs as well. It is to be appreciated that the overall size, shape and diameter of the disk discharge orifice 67 can vary from application to application without departing from the spirit and scope of the present invention. The important aspect of the disk discharge orifice 67 is that it provides a uniform, well-defined and consistent disk discharge orifice 67 which facilitates dispensing of the product 22 to be dispensed in a fine mist spray pattern.

The inventor hereby states his intent to rely on the Doctrine of Equivalents to determine and assess the reasonably fair scope of his invention as it pertains to any apparatus not materially departing from but outside the liberal scope of the invention as set forth in the following claims.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A dual component insert for insertion within a discharge cavity of a spray actuator for dispensing a pressurized product, the dual component insert comprising:

a support insert comprising:

a base wall having a support discharge orifice formed therein;

a cylindrical wall being formed integral with and extending from the base wall so as to define an insert cavity;

a single insert disk having a disk discharge orifice;

a diameter of the disk discharge orifice being smaller than a diameter of the support discharge orifice and ranging between 0.002 of an inch to 0.010 of an inch; and the single insert disk being received and captively retained within the insert cavity solely by engagement with the base wall and an inwardly facing surface of the cylindrical wall of the support insert such that the disk discharge orifice is axially aligned with the support discharge orifice with a first surface of the single insert disk directly abutting against the base wall of the support insert while an opposed second surface of the single insert disk, following seating of the support insert in a discharge cavity of the actuator, is in constant direct abutting engagement with a mechanical break-up formed in a cylindrical post of the actuator.

2. The dual component insert for use with the spray actuator according to claim 1, wherein the single insert disk has a diameter which ranges from about 0.100 of an inch to about 0.160 of an inch.

3. The dual component insert for use with the spray actuator according to claim 1, wherein the support insert is molded from plastic and the single insert disk is manufactured from metal.

4. The dual component insert for use with the spray actuator according to claim 1, wherein the disk discharge orifice has a diameter which ranges from about 0.0045 of an inch to about 0.0055 of an inch.

5. The dual component insert for use with the spray actuator according to claim 1, wherein the single insert disk is captively retained within the insert cavity by an interference fit achieved between the single insert disk and the support insert.

6. The dual component insert for use with the spray actuator according to claim 1, wherein the single insert disk is received by and captively retained within the insert cavity by one of an annular protrusion and a recess formed in the cylindrical wall of the support insert located closely adjacent the base wall.

7. The dual component insert for use with the spray actuator according to claim 1, wherein the single insert disk has a diameter which ranges from about 0.100 of an inch to about 0.160 of an inch, the disk discharge orifice has a diameter which ranges from about 0.0045 of an inch to about 0.0055 of an inch, and the single insert disk has a thickness which ranges from about 0.002 of an inch to about 0.010 of an inch.

8. The dual component insert for use with the spray actuator according to claim 7, wherein the support insert has a height which ranges from about 0.100 of an inch to about 0.150 of an inch, the support insert has a diameter which ranges from about 0.098 of an inch to about 0.152 of an inch, and a leading end of the cylindrical side wall of the support insert has a slight chamfer which assists with receiving and centering the single insert disk within the insert cavity.

9. An aerosol actuator for dispensing a pressurized aerosol product, the actuator comprising both:

a dual component insert comprising:

a support insert comprising:

a base wall having a support discharge orifice formed therein;

a cylindrical wall being formed integral with and extending from the base wall so as to define an insert cavity;

a single insert disk having a disk discharge orifice;

a diameter of the disk discharge orifice being smaller than a diameter of the support discharge orifice and ranging between 0.002 of an inch to 0.010 of an inch; and the single insert disk being received and captively retained within the insert cavity solely by engagement with the base wall and an inwardly facing surface of the cylindrical wall of the support insert such that the disk discharge orifice is axially aligned with the support discharge orifice with a first surface of the single insert disk directly facing and sealing against the base wall of the support insert;

a spray actuator comprising:

a housing having an inlet communicating, via a passageway, with an actuator discharge cavity;

the actuator discharge cavity being opened at one end and having a cylindrical post located therein supporting a mechanical break-up on an end face thereof; and the dual component insert being received and captively retained within the actuator discharge cavity of the spray actuator so as to seal the opened end of the actuator discharge cavity and facilitate dispensing of the aerosol product through the mechanical break-up and the axially aligned disk and support discharge orifices so that an opposed second surface of the single insert disk, following seating of the support insert in a discharge cavity of the actuator, is in constant direct abutting engagement with a mechanical break-up formed in a leading end of a cylindrical post of the actuator.

10. The spray actuator for dispensing the pressurized aerosol product according to claim 7, wherein the single insert disk has a diameter which ranges from about 0.100 of an inch to about 0.160 of an inch.

11. The spray actuator for dispensing the pressurized aerosol product according to claim 9, wherein the support insert is molded from plastic and the single insert disk is manufactured from metal.

12. The spray actuator for dispensing the pressurized aerosol product according to claim 9, wherein the disk discharge orifice has a diameter which ranges from about 0.0045 of an inch to about 0.0055 of an inch.

13. The spray actuator for dispensing the pressurized aerosol product according to claim 9, wherein the single insert disk is captively retained within the insert cavity by an interference fit achieved between the single insert disk and the support insert and the single insert disk is sandwiched between the base wall of the support insert and the leading end of the cylindrical post of the actuator.

14. The spray actuator for dispensing the pressurized aerosol product according to claim 9, wherein the single insert disk is captively retained within the insert cavity by one of an annular protrusion and a recess formed in the cylindrical wall of the support insert closely adjacent the base wall.

15. The spray actuator for dispensing the pressurized aerosol product according to claim 9, wherein the single insert disk has a diameter which ranges from about 0.100 of an inch to about 0.160 of an inch, the disk discharge orifice has a diameter which ranges from about 0.0045 of an inch to about 0.0055 of an inch, and the single insert disk has a thickness which ranges from about 0.003 of an inch to about 0.007 of an inch.

16. The spray actuator for dispensing the pressurized aerosol product according to claim 9, wherein the support insert has a height which ranges from about 0.100 of an inch to about 0.150 of an inch, the support insert has a diameter which ranges from about 0.098 of an inch to about 0.152 of an inch, and a leading end of the cylindrical side wall of the support insert has a slight chamfer which assists with receiving and centering the single insert disk within the insert cavity.

17. The spray actuator for dispensing the pressurized aerosol product according to claim 9, wherein the spray actuator is supported by a valve stem which is coupled to a valve assembly, and the valve assembly is secured to a mounting cup which is designed to be crimped to an aperture provided in a top portion of a pressurized container, and an inlet of the valve assembly supports a dip tube for conveying the aerosol product to be dispensed to the valve assembly and the spray actuator for dispensing.

18. An aerosol actuator for dispensing a pressurized aerosol product, the actuator comprising both:

a dual component insert comprising:

a support insert comprising:

a base wall having a support discharge orifice formed therein;

a cylindrical wall being formed integral with and extending from the base wall so as to define an insert cavity;

a single insert disk having a disk discharge orifice and the disk discharge orifice having a diameter ranging from 0.0045 of an inch to 0.0055 of an inch;

the single insert disk having an insert disk diameter ranging from about 0.100 of an inch to about 0.160 of an inch, and the single insert disk having a thickness ranging from about 0.003 of an inch to about 0.007 of an inch;

a diameter of the disk discharge orifice being smaller than a diameter of the support discharge orifice;

the single insert disk being received and a peripheral edge of the single insert disk being captively retained within the insert cavity solely by engagement with the base wall and an inwardly facing surface of the cylindrical wall of the support insert such that the disk discharge orifice is axially aligned with the support discharge orifice with a first surface of the single insert disk directly facing and sealing against the base wall of the support insert;

a spray actuator comprising:

a housing having an inlet communicating, via a passageway, with an actuator discharge cavity;

the actuator discharge cavity being opened at one end and the actuator discharge cavity having a cylindrical post located therein supporting a mechanical break-up on an end face thereof;

the cylindrical post supporting a plurality of spaced apart fins, and each of the plurality of spaced apart fins extending radially from the cylindrical post;

the dual component insert being received and captively retained within the actuator discharge cavity so as to seal the opened end of the actuator discharge cavity and facilitate dispensing of aerosol product through the mechanical break-up and the axially aligned disk discharge orifice and an opposed second surface of the single insert disk, following seating of the support insert in a discharge cavity of the actuator, directly facing the cylindrical post and directly, abutting against the mechanical break-up formed in the post; and the spray actuator being supported by a valve stem which is coupled to a valve assembly, an inlet of the valve assembly supporting a dip tube for conveying the aerosol product to be dispensed to the valve assembly, and the valve assembly being secured to a mounting cup.

* * * * *